US007009566B2

(12) United States Patent
Blaier et al.

(10) Patent No.: US 7,009,566 B2
(45) Date of Patent: Mar. 7, 2006

(54) ANTENNA FOR DVB-T RECEPTION

(75) Inventors: Werner Blaier, Kolbermoor (DE); Udo Flinner, Reutlingen (DE)

(73) Assignee: Kathrein-Werke AG, Rosenheim (DE)

( * ) Notice: Subject to any disclaimer, the term of this patent is extended or adjusted under 35 U.S.C. 154(b) by 0 days.

(21) Appl. No.: 10/487,142

(22) PCT Filed: Jul. 25, 2002

(86) PCT No.: PCT/EP02/08298

§ 371 (c)(1),
(2), (4) Date: Feb. 23, 2004

(87) PCT Pub. No.: WO03/019724

PCT Pub. Date: Mar. 6, 2003

(65) Prior Publication Data

US 2004/0239566 A1 Dec. 2, 2004

(30) Foreign Application Priority Data

Aug. 23, 2001 (DE) ..... 101 41 256

(51) Int. Cl.
*H01Q 1/24* (2006.01)

(52) U.S. Cl. ..... 343/702; 343/906

(58) Field of Classification Search ..... 343/702, 343/900, 903, 906, 878; 455/90
See application file for complete search history.

(56) References Cited

U.S. PATENT DOCUMENTS

| | | | | |
|---|---|---|---|---|
| 5,489,912 | A | 2/1996 | Holloway | 343/749 |
| 6,043,794 | A | 3/2000 | Faulkner et al. | 343/872 |
| 6,160,515 | A | 12/2000 | McCoy et al. | 343/702 |

FOREIGN PATENT DOCUMENTS

| | | |
|---|---|---|
| DE | 299 14 048 U 1 | 12/1999 |
| EP | 1 076 376 A2 | 2/2001 |
| EP | 0 904 639 B1 | 5/2001 |
| WO | 00/10222 | 2/2000 |

OTHER PUBLICATIONS

Article, Basilio et al.; "The Dependence of the Input Impedance of Feed Position of Probe and Microstrip Line-Fed Patch Antennas"; IEEE Transaction on Antennas and Propagation, vol. 49, No. 1 Jan. 2001, pp. 45-47.
Article, Chen; "Broadband Planner Monopole Antenna"; IEE Proc.-Microw. Antennas Propagation., vol. 147, No. 6, Dec. 2000, pp. 526-528.

*Primary Examiner*—Hoang V. Nguyen
(74) *Attorney, Agent, or Firm*—Nixon & Vanderhye P.C.

(57) ABSTRACT

The invention relates to an improved antenna for DVB-T reception which is characterized in that the antenna consists of a plate-shaped flat antenna.

9 Claims, 1 Drawing Sheet

ANTENNA FOR DVB-T RECEPTION

CROSS-REFERENCES TO RELATED APPLICATIONS

This application is the U.S. national phase of International Application No. PCT/EP02/08298 filed on 25 Jul. 2002, which designated the U.S. PCT/EP02/08298 claims priority to DE Application No. 101 41 256.8 filed 23 Aug. 2001. The entire contents of these applications are incorporated herein by reference.

FIELD

The technology herein relates to an antenna for DVB-T reception.

BACKGROUND AND SUMMARY

As is known, it is planned that the transmission of broadcast radio and television signals will be changed completely from the analogue standard to the digital standard by 2010 at the latest. Transmissions will then be based on the Digital Video Broadcasting (DVB) Standard, which is suitable for digital reception of video and audio data via satellite, via cable or via terrestrially transmitted programs. The expressions DVB-S (for satellite reception), DVB-C (for cable reception) and DVB-T when the signals are transmitted terrestrially are used in a corresponding manner.

Receivers for DVB-T reception generally have rod antennas which are provided at the receiver; are connected, for example, by means of plugs to an interface; and must have a specific length and a specific diameter to match the received frequency spectrum. Conventional rod antennas have a length of around 12 to 13 cm.

The object of technology herein is to provide an antenna which is better than such prior technology and which can be produced easily.

In contrast to rod omnidirectional antennas which are otherwise used, a flat antenna which is in the form of a plate is proposed according to an exemplary illustrative non-limiting implementation. In this case, the total area of the antenna is preferably of such a size that it corresponds to the surface area of a conventional rod antenna for the frequency transmission band under discussion for a corresponding DVB-T Standard.

In a development of the exemplary illustrative non-limiting implementation, the flat antenna which is in the form of a plate may be provided with edge sections which are in the form of flaps and which improve the matching.

It has been found to be advantageous for the flat antenna which is in the form of a plate to be designed as a type of printed circuit board which is provided, at least on one surface face, with a conductive layer which forms the antenna receiving surface. A corresponding interface in the form of a plug or of a socket can then be formed on this basic antenna material which is in the form of a printed circuit board, in order to connect the antenna formed in this way to a corresponding plug connection on the receiver itself.

The receiver itself or parts of the receiver housing may otherwise be used as an opposing surface.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
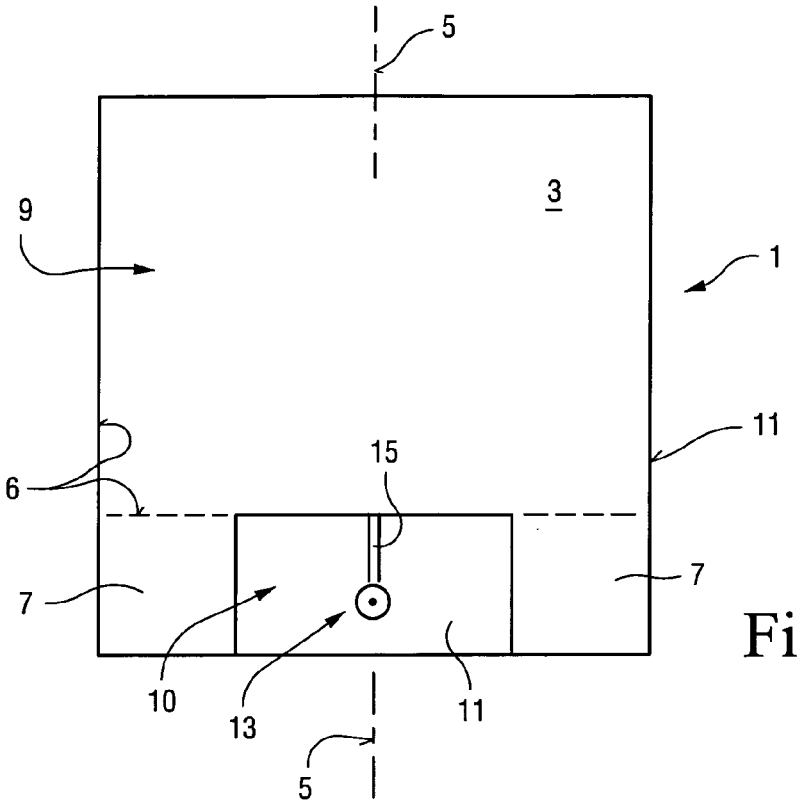
FIG. 1 shows an exemplary illustrative non-limiting schematic side view over the complete area of a DVB-T antenna.
Figure 2:
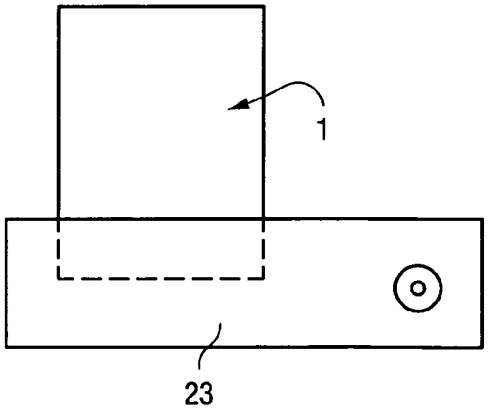
FIG. 2 shows a corresponding an exemplary non-limiting illustration of a view of the front face of the antenna, as is plugged onto a rearward face of a receiver.
Figure 3:
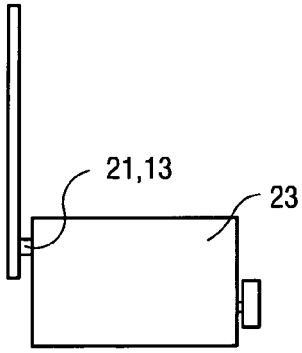
FIG. 3 shows an exemplary illustrative non-limiting side view, offset through 90°, of the antenna plugged onto the receiver in FIG. 2.

The drawings illustrate a flat antenna 1 which is in the form of a plate and may be composed of a conductive metal plate or metal sheet. It may also be produced from a dielectric mount, for example a mount material 11 which is in the form of a printed circuit board and on at least one face of which a metallically conductive layer 3 is formed. In the illustrated exemplary non-limiting arrangement, the flat antenna which is in the form of a plate is in principle rectangular. In the illustrated exemplary non-limiting arrangement, it has two coupling areas 7 to the left and to the right of a vertical axis of symmetry 5 in the left-hand and right-hand lower area adjacent to the rectangular shape 6 of the antenna 1 and, in the end, these lead to an enlargement of the total antenna area.

A plug arrangement 13 is formed in the non-conductive printed circuit board area, or other area, 10 of the mount material 11, between this coupling surface 7 and the upper large antenna section 9, and is electrically connected via an electrical connecting line 15 to the large antenna array section 9.

The flat antenna 1 which is in the form of a plate and is formed in this way can be plugged by means of its plug device 13 to, for example, a corresponding plug or socket arrangement 21 on the rear face of the receiver 23. The plug device not only holds the antenna 1, which is in the form of a plate, mechanically, but also connects it electrically to the receiver 23.

The antenna area is of such a size that it corresponds approximately to the surface area of a conventional rod antenna, for the frequency transmission band under discussion. A conventional rod antenna, for example, has a length of about 80 to 90 mm and a diameter of 8 to 9 mm, up to a length of 15 cm and a diameter of virtually 15 mm. Overall, in this case, the antenna area may then, for example, have values of 1000 $mm^2$ to 8000 $mm^2$, particularly when the antenna is operated in the DVB-T transmission band from 470 MHz to 872 MHz. If it is also intended to extend the transmission band in the direction of the VHF band, then the dimensions could be even larger.

Apart from the exemplary non-limiting arrangement which is illustrated and has been explained, a modified form is also feasible, in which, for example, the antenna is not plugged directly into the receiver but is placed on and/or plugged to a separate stand foot. To this extent, the antenna may also be provided with a fixed stand foot. This stand foot may, for example, also contain an amplifier, which is connected to the receiver by an antenna connecting cable, and is supplied with power from the receiver. Thus, in an entirely general form, the antenna may be installed or fitted separately from the receiver, and is then connected to a receiver via an antenna cable or in the form of a repeater.

The antenna has been described for the situation in which the antenna element is completely flat and planar. However, if required, it is also possible for the antenna to have at least slight spherical curvature, for example slight cylindrical curvature about at least one axis, as well. However, the longitudinal and lateral extent of the antenna element, which is intrinsically kept flat and planar, in both extent directions of the planar or slightly curved antenna element is very much greater than its possible slight extent transversely with respect to this plane.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

The invention claimed is:

1. An antenna for DVB-T reception, comprising:

an isolating mount having at least one surface or face provided with a metallization layer, said layer providing a substantially rectangular flat antenna in the form of a plate, a plug arrangement provided on the isolating mount in electrical contact with the metallization layer, the plug arrangement making electrical contact with the flat antenna and mechanically anchoring the flat antenna to a receiver, first and second coupling sections positioned offset with respect to a vertical axis or plane of symmetry of the rectangular flat antenna, whereby the overall length or height of the antenna and by that the size of the antenna area is enlarged, a non-conductive region being disposed on the isolating mount between the coupling sections, the plug arrangement being provided in the non-conductive region on the isolating mount provided between the coupling sections.

2. The antenna as claimed in claim 1, wherein the size of the surface of the flat antenna which is in the form of a plate corresponds to a comparable rod antenna, with a round cross section, for DVB-T reception.

3. The antenna as claimed in claim 1, wherein the antenna is formed from a metal plate.

4. The antenna as claimed in claim 1, wherein the isolating mount, comprises a printed circuit board, with at least one surface or face of the isolating mount being provided with a metallization layer on said printed circuit board.

5. The antenna as claimed in claim 1 further including an associated receiver, wherein the receiver or parts thereof is or are used as an opposing surface.

6. The antenna as claimed in claim 1, further including a stand, installation or suspension apparatus, the antenna being coupled to said apparatus, the antenna being connectable to the receiver via a separate antenna cable.

7. The antenna as claimed in claim 6, wherein the antenna is mechanically and electrically connected, by a coaxial plug connection, to a standard device or a stand foot, from which the antenna cable is connected to the receiver.

8. The antenna as claimed in claim 6, wherein the antenna, an antenna housing and/or an installation or stand device are/is equipped with active or passive amplification, attenuation or damping, and/or filtering components.

9. A DVB-T antenna system comprising:

a non-conductive mount having a conductive layer disposed thereon, said conductive layer providing a substantially rectangular, planar RF antenna surface, said antenna surface defining an axis of symmetry, a non-conductive isolating region being formed in the conductive layer;

first and second coupling sections disposed on the mount in an offset manner with respect to said axis of symmetry to thereby enlarge the effective size of said antenna surface; and a plug arrangement disposed in the non-conductive isolating region for electrically and mechanically coupling a receiver to said antenna surface.

* * * * *